US007111670B2

(12) United States Patent
Yoshioka et al.

(10) Patent No.: US 7,111,670 B2
(45) Date of Patent: Sep. 26, 2006

(54) PLATE FIN FOR HEAT EXCHANGER AND HEAT EXCHANGER CORE

(75) Inventors: Jun Yoshioka, Yokaichi (JP); Kiyoshi Sasaki, Yokaichi (JP); Johji Satoh, Yokaichi (JP)

(73) Assignee: T. RAD Co., Ltd., Tokyo (JP)

( * ) Notice: Subject to any disclaimer, the term of this patent is extended or adjusted under 35 U.S.C. 154(b) by 0 days.

(21) Appl. No.: 10/540,654

(22) PCT Filed: Dec. 19, 2003

(86) PCT No.: PCT/JP03/16423

§ 371 (c)(1),
(2), (4) Date: Jun. 23, 2005

(87) PCT Pub. No.: WO2004/059234

PCT Pub. Date: Jul. 15, 2004

(65) Prior Publication Data

US 2006/0070726 A1 Apr. 6, 2006

(30) Foreign Application Priority Data

Dec. 25, 2002 (JP) ..... 2002-375628

(51) Int. Cl.
*F28F 1/22* (2006.01)

(52) U.S. Cl. ..... 165/152; 165/151

(58) Field of Classification Search ..... 165/148, 165/151, 152

See application file for complete search history.

(56) References Cited

U.S. PATENT DOCUMENTS

| | | | | | |
|---|---|---|---|---|---|
| 1,821,995 | A * | 9/1931 | Wayman | 165/149 |
| 2,018,922 | A * | 10/1935 | Palmer | 165/152 |
| 2,532,302 | A * | 12/1950 | Hayward | 29/890.047 |
| 3,147,800 | A * | 9/1964 | Tadewald | 165/164 |
| 4,778,004 | A * | 10/1988 | Paulman et al. | 165/150 |
| 5,704,123 | A * | 1/1998 | Paulman et al. | 29/890.053 |
| 6,401,807 | B1 * | 6/2002 | Wyler et al. | 165/121 |
| 6,688,380 | B1 * | 2/2004 | Lavochkin et al. | 165/150 |

FOREIGN PATENT DOCUMENTS

| | | | |
|---|---|---|---|
| JP | 05060482 | A * | 3/1993 |
| JP | 05272887 | A * | 10/1993 |

* cited by examiner

*Primary Examiner*—Allen J. Flanigan
(74) *Attorney, Agent, or Firm*—Jordan and Hamburg LLP

(57) ABSTRACT

A plate type heat exchanger employing flat tubes, which can be manufactured easily and which have a high heat exchange performance includes a thin strip-shaped metal plate cut in the width direction and having remaining small connected portions and many cut portions disposed at fixed intervals in the longitudinal direction slits are formed in both sides of the cut potions having the same center. The strip-shaped metal plate is bent at the connected portions in a zigzag manner to form an aggregation of fin elements, and the flat tubes are engaged with the front and rear sides of the aggregation of the fin elements.

5 Claims, 7 Drawing Sheets

PLATE FIN FOR HEAT EXCHANGER AND HEAT EXCHANGER CORE

TECHNICAL FIELD

The present invention relates to a plate fin type heat exchanger that has flat tubes, and more particularly to a heat exchanger of a type in which flat tubes are pressed into slits on each plate fin.

BACKGROUND ART

Conventionally, fins applied to flat tubes that have been used generally in a radiator for automobile and a condenser for car air conditioner are corrugated fins.

It seems that corrugated fins have almost reached to a saturated level technically and further contrivance to reduce air resistance significantly than the current level, to increase performance or to reduce weight is approaching to the limit.

Corrugated fins are applicable to radiators for automobiles, condensers for car air conditioners and outdoor units of air conditioners. However, there reside such problems as drainage of condensed water, frost accumulation in heating operation and the like. Therefore, the corrugated fins cannot be applied to heat exchangers (evaporators) for air conditioner indoor units, heat pump outdoor units or evaporators for refrigerators and automatic vending machines. Thus, the corrugated fins may be evaluated to be poor in applicability.

The reason of the above is as described below. That is, when incorporated into a heat exchanger, corrugated fins are remarkably poor in drainage performance due to the configuration thereof, and therefore frost gathers and grows swiftly; and further, the frost is hardly removed.

What can solve the above disadvantages of corrugated fins is plate fins having flat holes. However, being different from the case where a tube having a circular section (round tube) is used, it is difficult to insert the flat tube into the flat hole. To enhance insertion efficiency, clearance between the flat hole and the periphery of the flat tube has to be large enough. When the enough clearance is provided, the contact between the tube and the fin is deteriorated, resulting in reduction of performance.

Being different from the case of the round tube, the flat tube cannot be satisfactorily expanded from the inside thereof. To join the flat tube to the flat hole, brazing is necessary. However, when the clearance is formed large enough to ensure the insertion efficiency, brazing material is not satisfactorily supplied to the gap between the two; thus, the contact between the two is deteriorated, resulting in a reduction of the heat conductivity. Contrarily, when the clearance is formed small enough to ensure satisfactory brazing, the insertion efficiency of the tube is lowered, resulting in an extreme reduction of the productivity.

When the flat tube expanded on purpose is brazed, the final contact is satisfactorily ensured, even if the clearance is formed large enough. In such a case, however, expansion process of the tube needs to be added, which leads to such disadvantages as redundant process, poor productivity and a big investment for equipment.

A flat multi-hole tube is sometimes used for a heat exchanger of air conditioner. In this case, however, the tube is not allowed to be expanded.

So called an insertion type heat exchanger as described below has been proposed. That is, in place of forming flat holes in a long plate fin, slits of a U-like shape are formed from one end of a plate fin in the width direction thereof and flat tubes are forcibly inserted into the slits (refer to, for example, Patent Document 1).

According to this method, even when the clearance between the slit and the tube is small, the tube can be forcibly inserted easily into the fin from the side thereof. As a result, the contact between the tube and the fin is improved.

However, the plate type heat exchanger with slit fins as described above has a following disadvantage. That is, when the individual plate fins are gathered together and many slits are to be aligned, it is difficult to align them into a line properly and thus, handling is troublesome. Therefore, the plate type heat exchanger has not been put into volume production.

The following method is theoretically conceivable; i.e., many slits, which are parallel to each other in the width direction, are formed in a long plate fin, and flat tubes are pressed into the slits from one end thereof. However, it is difficult to align the slits in the plate fins and form a fin assembly practically.

Further, there arises such disadvantage that the core assembly has poor workability in engaging the tubes with the fins, since the slits are hardly aligned with each other. Accordingly, although the heat exchanger core of this type using flat tubes is theoretically recognized as an effective heat exchanger core, this heat exchanger core has not been put into practical use as far as the inventor of the present invention knows.

Accordingly, an object of the present invention is to provide plate fins for a heat exchanger and a heat exchanger core employing the same, that have good alignment efficiency for the slits of plate fins and thus excellent productivity of mass production.

Further, another object of the present invention is to provide plate fins for a heat exchanger and a heat exchanger core employing the same that allow the flat tubes to be engaged therewith in two rows.

DISCLOSURE OF THE INVENTION

The present invention relates to a plate fin for a heat exchanger: comprising a thin strip-shaped metal plate (18), having many cur portions (2) which are cut in the width direction thereof remaining connected portions (1) of a small length respectively relative to the full width thereof, wherein each cut portion (2) is disposed away from each other at fixed intervals in the longitudinal direction;

slits (3) crossing the cur portions (2) having each cur portion as a center are disposed in parallel being away from each other in the width direction in the strip-shaped metal plate (18); wherein the strip-shaped metal plate (18) is bent in a manner of a zigzag at the connected portion (1) to form an aggregation (24) of continuous fin elements; and flat tubes (4) that can be engaged with an aggregation portion of the slits (3) from the opening side that are formed in the front and rear sides of the aggregation (24) of the fin elements.

Slits (3) neighboring in the longitudinal direction of the strip-shaped metal plate (18) are disposed in a zigzag manner.

The connected portion (1) extends in the direction towards the slits (3), one of the sides (5) thereof is formed in a V-like shape and another is formed in an inversed V-like shape opposing to each other, and the protruding portion of each V-like shape is bent to form a bent portion (20).

Flat tubes (4) are engaged with aggregation portion of slits (3) formed in the front and rear sides respectively of the aggregation (24) of the fin elements from the opening side of the slits (3).

The periphery of the flat tube (4) and the slits (3) are brazed.

The plate fin for heat exchanger and the heat exchanger core according to the present invention are structured as described above, and have the following advantages.

The plate fin for heat exchanger according to the present invention is structured as described below. That is, many cut portions 2 are formed remaining small connected portions 1, slits 3 are formed at the both sides of the cut portion 2 as a center, the strip-shaped metal plate 18 is bent in a manner of zigzag at the connected portion 1; thus, the aggregation 24 of the continuous fin elements is structured. And it is arranged in such a way that the flat tubes 4 can be engaged with the aggregation of the slits 3 from the opening side formed in the front and rear sides of the aggregation 24 of the fin elements.

Accordingly, since all fin elements are connected continuously with each other at the connected portion 1, each of the slits 3 can be reliably aligned with each other. Thus, the flat tubes 4 can be easily inserted into the slits 3. Thereby, a plate fin for heat exchanger with high reliability as well as high productivity for mass production can be obtained.

Moreover, in the plate fin, since the flat tubes 4 can be engaged with the aggregation 24 of fin elements at the front and rear sides thereof, so-called a double tube type heat exchanger can be structured. Thus, a compact plate fin with high heat exchange performance can be obtained.

In the above structure, the slits 3 neighboring in the longitudinal direction of the strip-shaped metal plate 18 can be disposed in a zigzag manner. Owing to this arrangement, the front side flat tube 4 and the rear side flat tube 4 in the aggregation 24 of fin elements can be disposed closer to each other. Thus, a compact heat exchanger with high performance can be provided.

In the above structure, one of the two sides 5 of the connected portion 1 is formed into a V-like shape; and another side is formed into an inversed V-like shape. The protruding portions of V-like shape may be bent into the bent portions 20. Owing to this arrangement, the connected portion 1 can easily specify the gap between the fin elements, and the entire connected portion 1 can be rigidly structured.

Further, the heat exchanger core employing the above-described plate fin can be manufactured easily and precisely.

BEST MODES FOR CARRYING OUT THE INVENTION

Now, an embodiment of the present invention will be described with reference to the drawings.

Figure 1:
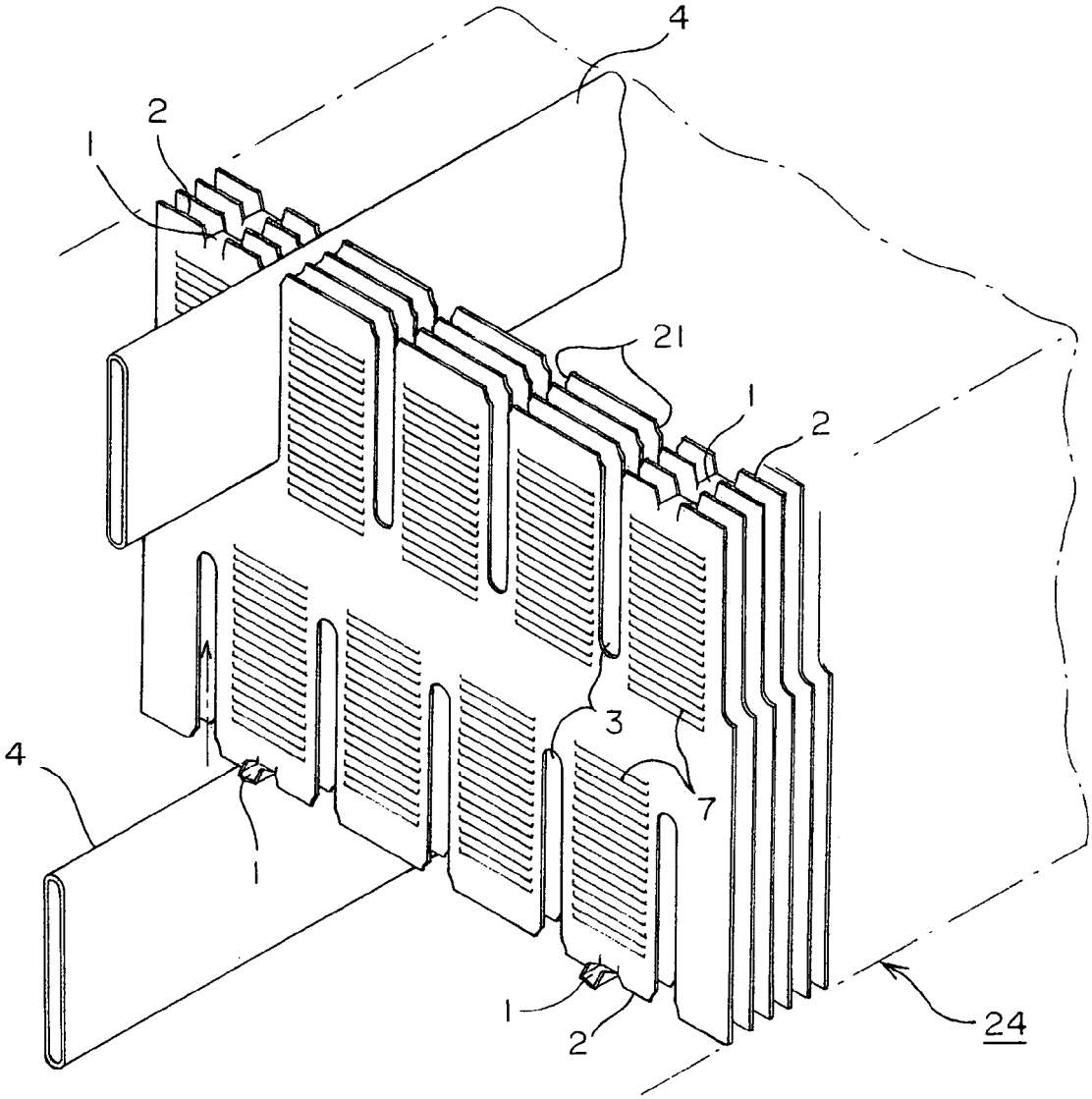
FIG. 1 is a view illustrating assembly of a heat exchanger core in accordance with the present invention.
Figure 2:
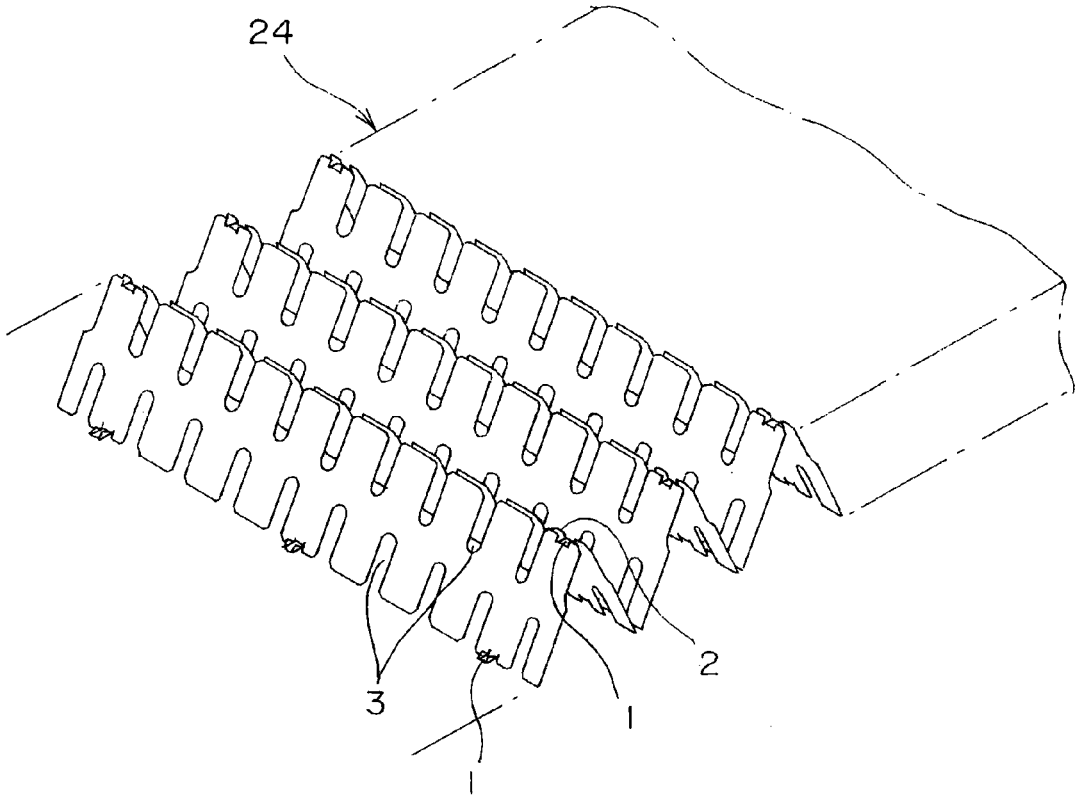
FIG. 2 is a perspective view illustrating an aggregation 24 of fin elements used in the heat exchanger core, which is under manufacturing process.
Figure 3:
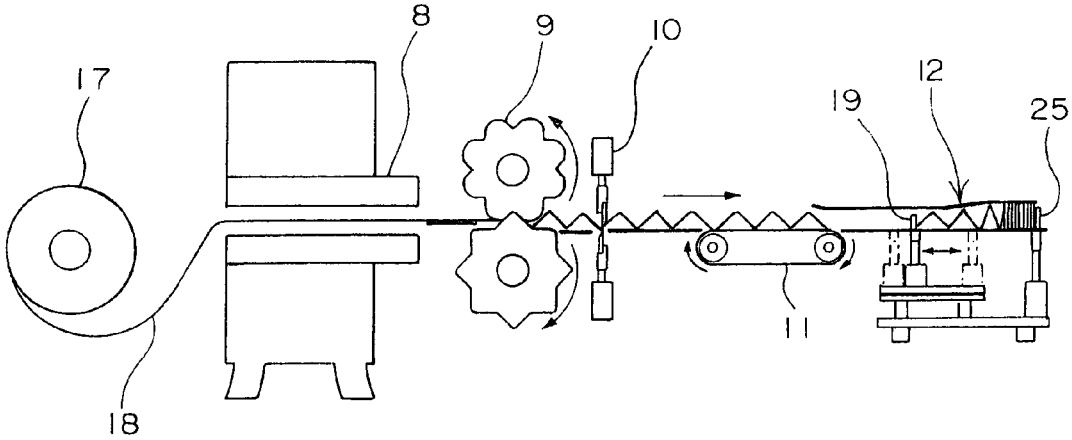
FIG. 3 is an illustration of manufacturing process of the aggregation 24 of the fin elements.
Figure 4:
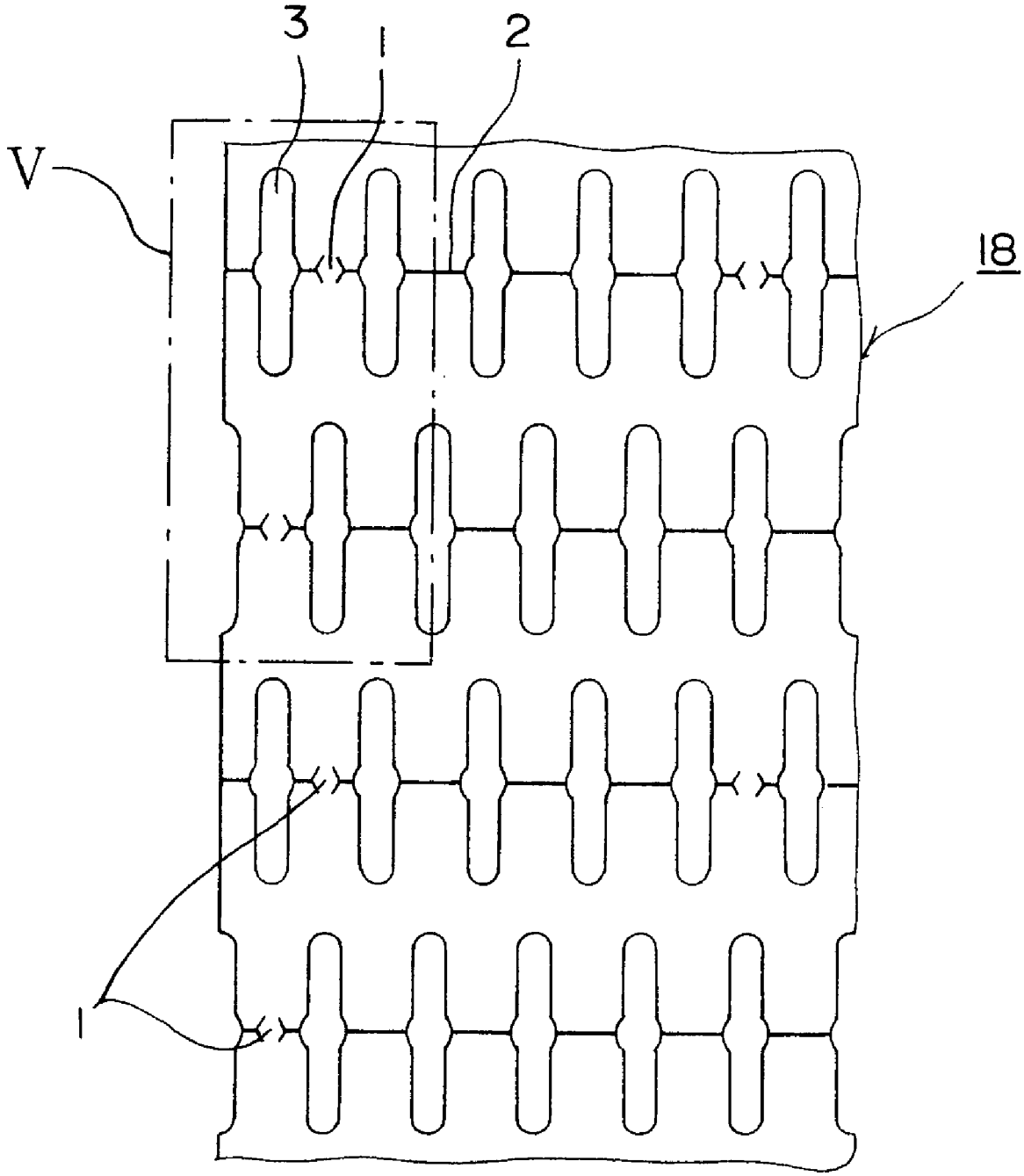
FIG. 4 is a plan view of a strip-shaped metal plate 18 under manufacturing process, which is formed by press dies.
Figure 5:
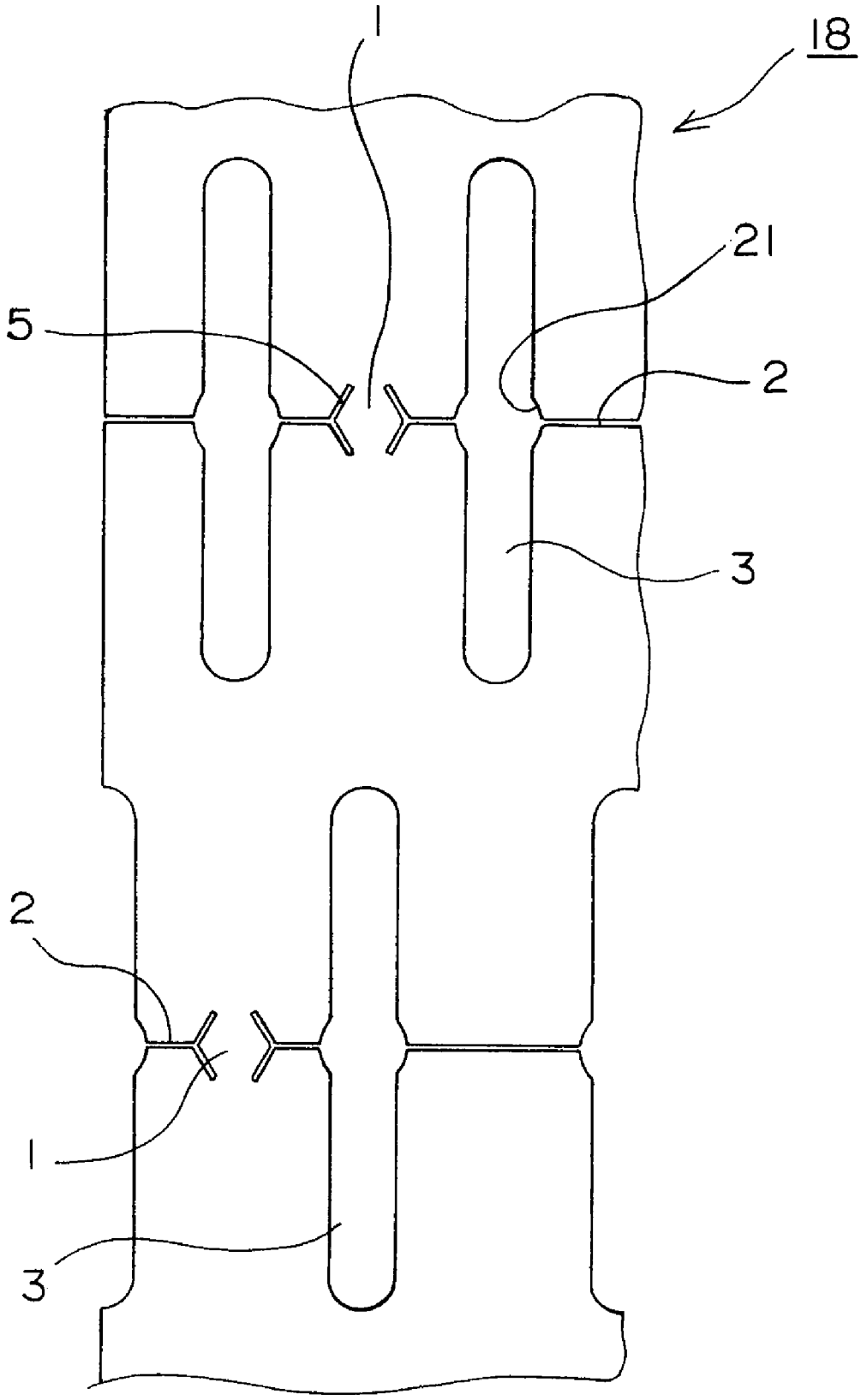
FIG. 5 is an enlarged view of a portion V in FIG. 4.
Figure 6:
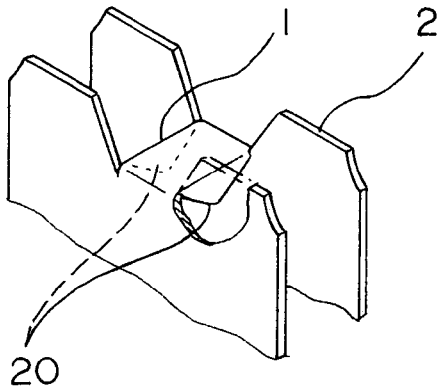
FIG. 6 is an illustration of a principal portion of a connected portion 1 of fin element aggregation 24.

FIG. 1 is an exploded perspective view of an principal portion of a heat exchanger core in accordance with the present invention, FIG. 2 is an illustration showing a part of a plate fin thereof under manufacturing process, FIG. 3 is an illustration of the entire manufacturing process thereof, FIG. 4 is a plan view of an principal portion of a strip-shaped metal plate 18 under a press-forming process in FIG. 3, and FIG. 5 is an enlarged view of a portion V in FIG. 4. Further, FIG. 6 is a perspective view illustrating each connected portion 1 in aggregation 24 of the fin elements.

As shown in FIG. 1, the heat exchanger core is arranged so that a strip-shaped thin metal plate 18 is folded into a zigzag shape to form an aggregation 24 of fin elements. From the front side and the rear side in the thickness direction of the aggregation 24 of the fin elements, flat tubes 4 are engaged with slits 3 respectively to assemble the heat exchanger core. And then, the periphery of the flat tube 4 and the slit 3 are brazed to fix them to each other.

The aggregation 24 of the fin elements is bent in a manner of zigzag folding at each of the connected portions 1 having a small width for connecting each fin element.

FIG. 2 is a perspective view of a principal portion of the fin element. FIG. 4 and FIG. 5 show a state of the fin element before being bent. The strip-shaped thin metal plate 18 is arranged so that many slits 3 and cut portions 2 are formed by means of pressing operation and small connected portions 1 are left in a part of the cut portions 2. That is, the cut portions 2 are formed in the width direction of the fin element remaining connected portions 1 of a small length relative to the full width of the fin element. The cut portions 2 are formed at regular intervals in the longitudinal direction of the fin element. Having the cut portions 2 as central portions, elongated circular slits 3 are formed in the longitudinal direction of the fin element crossing the cut portions 2. Many slits 3 as described above are formed in parallel in the width direction of the fin element with constant intervals.

Note that in the central area of each slit 3, circular portions 21 are formed. The slits 3 neighboring in the longitudinal direction are disposed in a zigzag manner. In place of the disposition in a zigzag manner, the slits 3 may be formed so that the center lines thereof are aligned with each other.

In this embodiment, the connected portions 1 are disposed at the center between a pair of the slits 3 neighboring in the width direction and formed in the direction of the slits 3. As shown in FIG. 5, at the both sides 4 thereof, a cut of a V-like shape is formed at one side; and a cut of an inversed V-like shape is formed at another side. A protruding portion of the V-like shape is, as shown in FIG. 6, bent later to form a bent portion 20 to structure the entire connected portion 1 rigidly.

Forming of the plate fin is carried out using, for example, press dies 8 shown in FIG. 3. That is, the strip-shaped metal plate 18 is firstly supplied to the press die 8 to form the aggregation 24 of the continuous fin elements as shown in FIG. 4 and FIG. 5. Thereafter, the strip-shaped metal plate 18 is supplied between a pair of bending rolls 9, which are engaging with each other, and as shown in FIG. 2, the strip-shaped metal plate 18 is bent in a manner of zigzag folding and transferred toward the lower stream.

The strip-shaped metal plate may be formed by an upper-limit die by means of progressive pressing operation in place of a pair of bending rolls 9.

When the number of the fin elements of the aggregation 24 has reached a predetermined number, the strip-shaped metal plate is cut off at a connected portion 1 with a fin cutter 10. The aggregation 24 of the fin elements is fed quickly by quick-feeding conveyer 11 to a core-assembling unit 12. Then, a fin pushing plate 19 pushes the tail end of the aggregation 24 of the fin elements, and the aggregation 24 of the fin elements with a predetermined pitch is formed between the fin pushing plate 19 and a stopper 25.

The aggregation 24 of the fin elements formed as described so far is laminated as shown in FIG. 1, and the slits 3 in each of the fin elements are aligned with each other. The aggregations of the slits 3 are disposed at the upper side and the lower side of the aggregation 24 of the fin elements. Then, the flat tubes 4 are pressed into each slit 3 from the upper and lower sides; thus, the heat exchanger core is assembled. Note that an aluminum multi-hole extruded tube, an extruded aluminum tube with no partition therein or an extruded aluminum tube with a section of θ-like shape may be employed for the flat tube 4. A flat tube 4 of which outer surface is previously coated with a brazing material is preferably used.

Figure 8A:
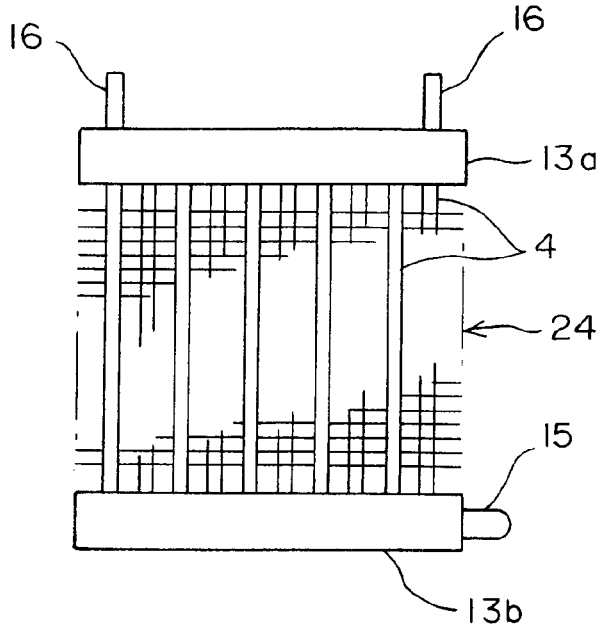
FIG. 8 shows a front view and a side view of a first embodiment of a heat exchanger employing the heat exchanger core in accordance with the present invention.
Figure 8B:
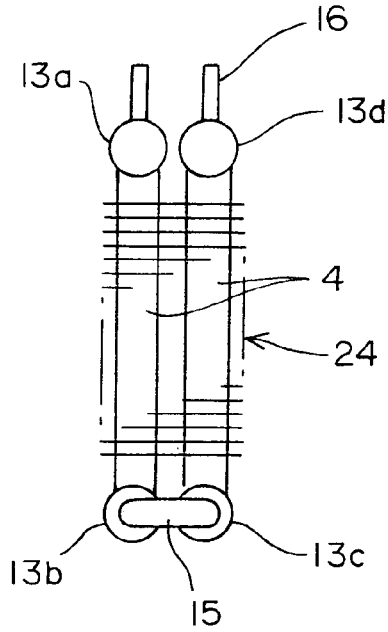

Next, the both ends of each flat tube 4 of the heat exchanger core, which has been assembled as described so far, are inserted into the flat holes of four headers 13*a* to 13*d* arranged in the upper and lower portion as shown in FIG. 8. The lower headers 13*b* and 13*c* are connected with each other via a header connection tube 15. Also, protruding input and output pipes 16 are provided to the upper headers 13*a* and 13*d*; thus, the heat exchanger is assembled.

Such heat exchanger is placed in a high temperature furnace to braze the outer periphery of each flat tube 4 and the inner periphery of the slits 3 of the fin elements together, and also to braze the both ends of the flat tubes 4 and the headers 13*a* to 13*d* to fix them liquid tightly.

Figure 9A:
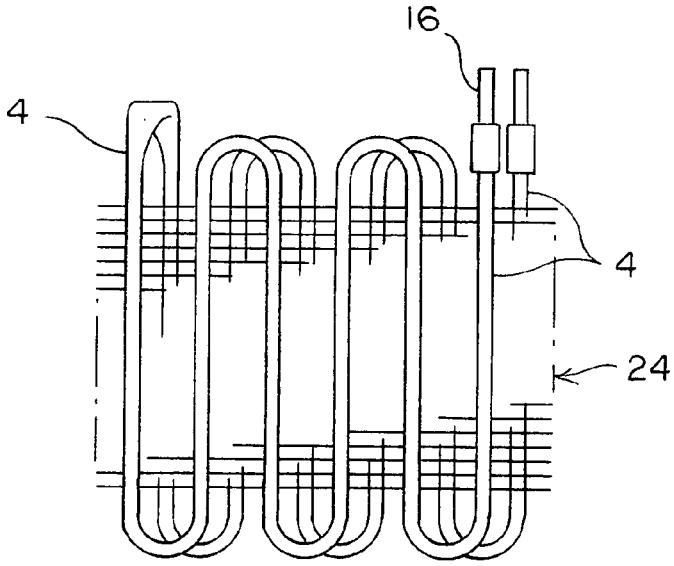
FIG. 9 shows a front view and a side view of a second embodiment thereof.
Figure 9B:
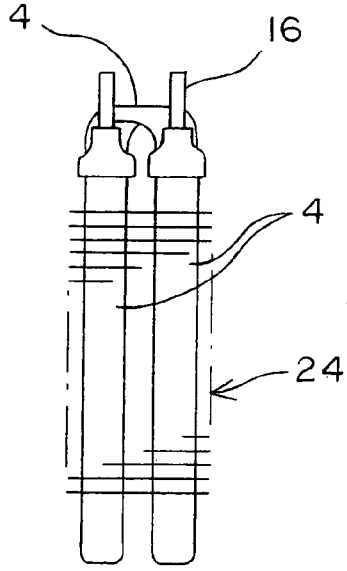

In the above described example, many flat tubes 4 of a predetermined length are used. In place of the above, as shown in FIG. 9, such an arrangement may be adopted that a long flat extruded tube is bent in a meandering shape, and the straight portion thereof is engaged with each slit 3.

Figure 10A:
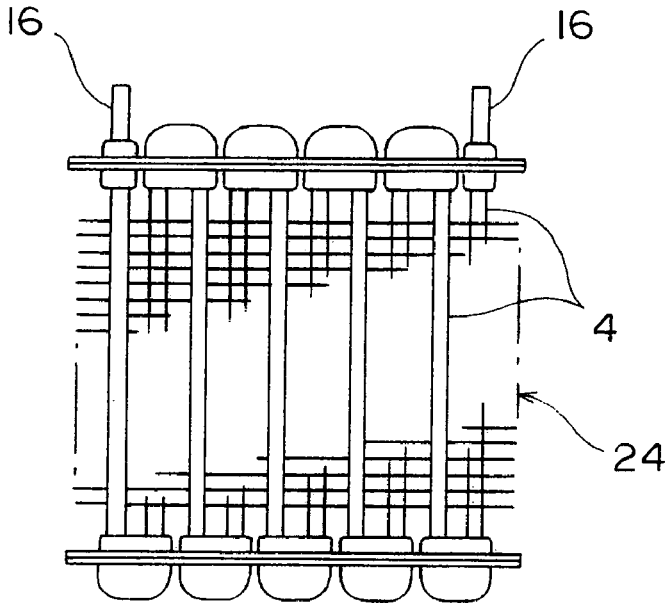
FIG. 10 shows a front view and a side view of a third embodiment thereof.
Figure 10B:
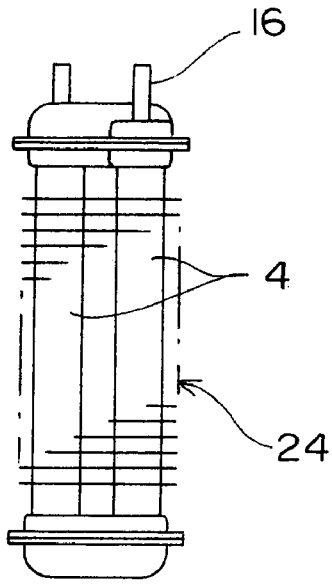

FIG. 10 schematically shows a heat exchanger employing a press bent header; FIG. 10(A) is a front view thereof, and FIG. 10(B) is a side view thereof. This heat exchanger employs many straight flat tubes, and neighboring flat tubes are connected to each other; thus, substantially the same meandering flow path as that shown in FIG. 9 is formed.

Figure 7:
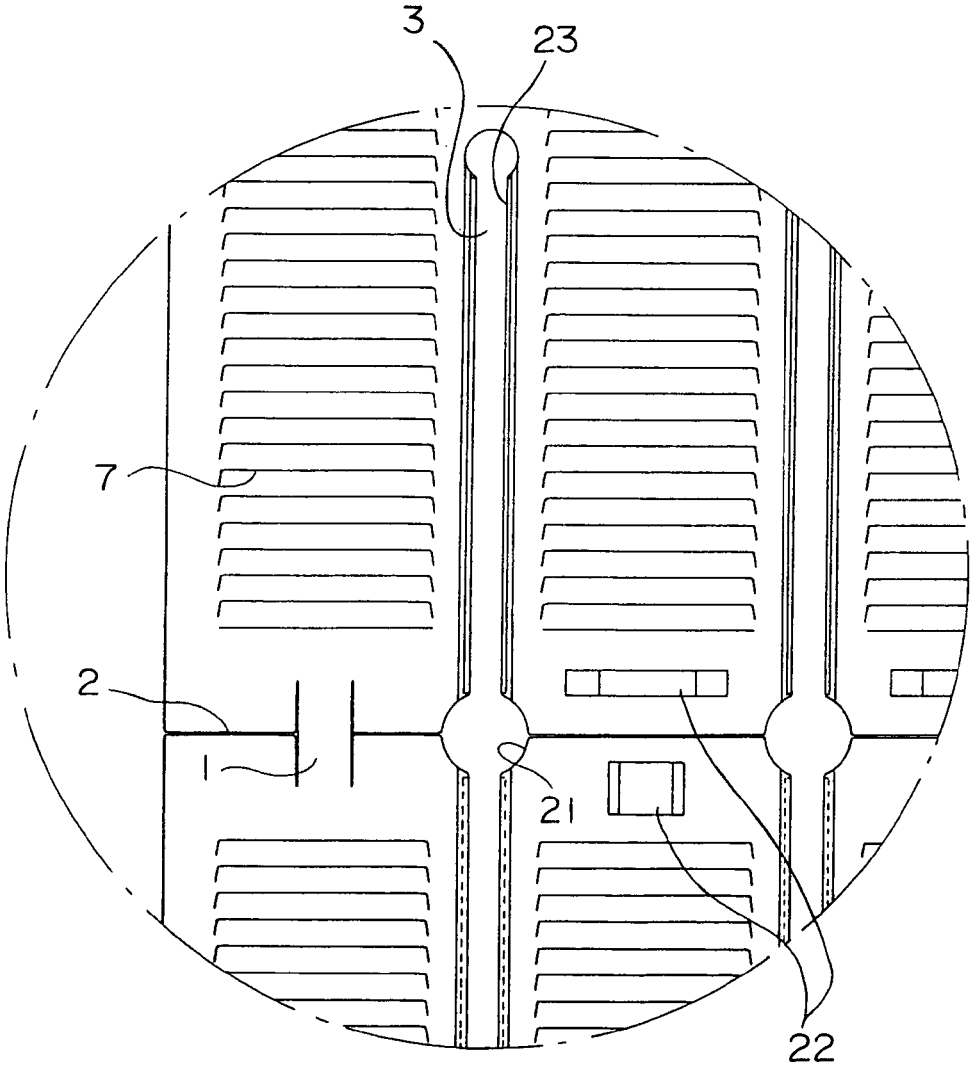
FIG. 7 is a plan view showing another example of the portion in FIG. 5.

As a modification of the strip-shaped metal plate 18 shown in FIG. 5, the strip-shaped metal plate may be structured as shown in FIG. 7. In this example, the slit edges 23 of the slit 3 are slightly bent into an inversed L-like shape in section. Also, at the both sides of the cut portion 2, pairs of spacer portions 22 are formed. It is arranged that pairs of spacer portions 22 are brought into contact with each other when the strip-shaped metal plate is bent at the cut portion 2, thereby the gap between the fin elements be specified.

Note that in this example also, each fin element is cut and raised up to form many louvers 7.

These louvers 7 may be or may not be formed.

The invention claimed is:

1. Plate fins for a heat exchanger: comprising a thin strip-shaped metal plate having a plurality of cut portions which are cut in the width direction thereof and having remaining connected portions of a small length respectively relative to the full width thereof, wherein the cut portions are spaced from each other at fixed intervals in the longitudinal direction;

slits crossing the cut portions having each cut portion as a center are disposed in parallel being spaced from each other in said width direction in said strip-shaped metal plate;

said strip-shaped metal plate is bent in a manner of a zigzag at said connected portion to form an aggregation of continuous fin elements;

flat tubes can be engaged with said slits from the opening side that are formed in front and rear side respectively in the aggregation of the fin elements.

2. The plate fins for heat exchanger according to claim 1, wherein said slits neighboring in the longitudinal direction of said strip-shaped metal plate are disposed in a zigzag manner.

3. The plate fins for heat exchanger according to claims 1 or 2, wherein said connected portion extends in the direction towards said slits, one of the two sides thereof is formed in a V-like shape and another is formed in an inversed V-like shape opposing to each other, and the protruding portion of each V-like shape is bent to form a bent portion.

4. A heat exchanger core, using any one of plate fins for heat exchanger according to claims 1 or 2, wherein flat tubes are engaged with aggregation portion of slits formed in the front and rear sides respectively of the aggregation of said flit elements from the opening side of the slits.

5. The heat exchanger core according to claim 4, wherein the periphery of the flat tube and said slits are brazed.

* * * * *